US005520255A

United States Patent [19]

Barr et al.

[11] Patent Number: 5,520,255

[45] Date of Patent: May 28, 1996

[54] MODULATED BIAS UNIT FOR ROTARY DRILLING

[75] Inventors: John D. Barr, Cheltenham; Richard E. Thorp, Frampton-Cotterell; Robert A. Russell, Barnwood, all of England

[73] Assignee: Camco Drilling Group Limited, Stonehouse, England

[21] Appl. No.: 455,455

[22] Filed: May 31, 1995

[30] Foreign Application Priority Data

Jun. 4, 1994 [GB] United Kingdom ..... 9411228

[51] Int. Cl.[6] ..... E21B 7/08

[52] U.S. Cl. ..... 175/24; 175/61; 175/73

[58] Field of Search ..... 175/24, 26, 45, 175/61, 73, 76

[56] References Cited

U.S. PATENT DOCUMENTS

| | | | |
|---|---|---|---|
| 4,637,479 | 1/1987 | Leising | 175/26 |
| 5,314,030 | 5/1994 | Peterson et al. | 175/26 |
| 5,449,046 | 9/1995 | Kinnan | 175/24 |

FOREIGN PATENT DOCUMENTS

| | | | |
|---|---|---|---|
| 530045 | 3/1993 | European Pat. Off. | 175/73 |
| 2257182 | 1/1993 | United Kingdom . | |
| 2259316 | 3/1993 | United Kingdom | 175/73 |

*Primary Examiner*—Stephen J. Novosad

[57] ABSTRACT

A modulated bias unit, for controlling the direction of drilling of a rotary drill bit when drilling boreholes in subsurface formations, comprises a number of hydraulic actuators spaced apart around the periphery of the unit, each having a movable thrust member which is hydraulically displaceable outwardly for engagement with the formation of the borehole being drilled. A selector control valve modulates the fluid pressure supplied to each actuator in synchronism with rotation of the drill bit so that, as the drill bit rotates, each movable thrust member is displaced outwardly at the same selected rotational position so as to bias the drill bit laterally and thus control the direction of drilling. The control valve is a disc valve comprising two relatively rotating elements having contiguous surfaces formed of polycrystalline diamond. The elements are maintained in coaxial relation by a polycrystalline diamond bearing pin which extends axially from one element and engages in a central axial bearing aperture in the other element.

10 Claims, 4 Drawing Sheets

FIG 4
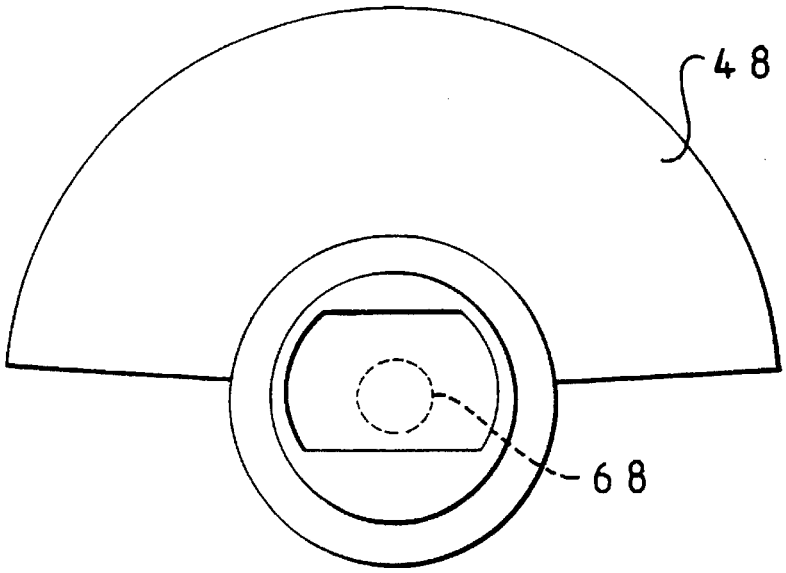
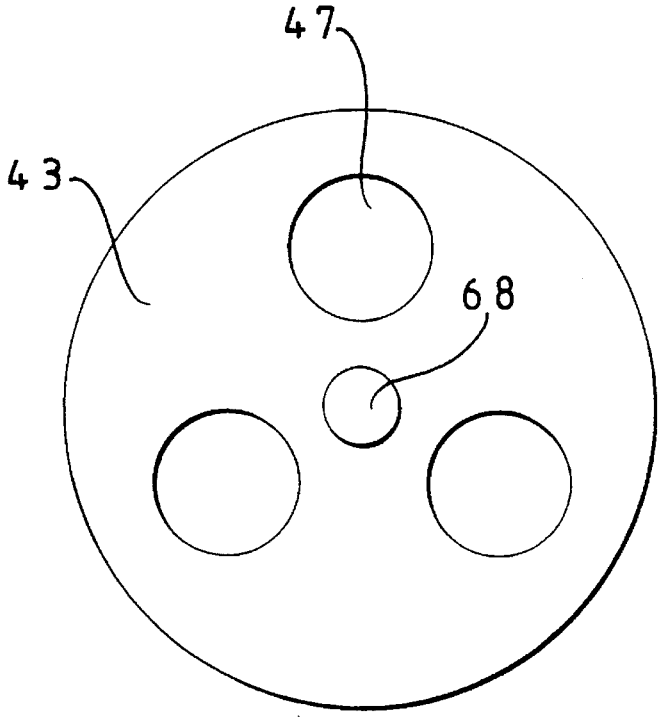
FIG 5

MODULATED BIAS UNIT FOR ROTARY DRILLING

BACKGROUND OF THE INVENTION

When drilling or coring holes in subsurface formations, it is often desirable to be able to vary and control the direction of drilling, for example to direct the borehole towards a desirable target or to control the direction horizontally within the payzone once the target has been reached. It may also be desirable to correct for deviations from the desired direction when drilling a straight hole, or to control the direction of the hole to avoid obstacles.

The two basic means of drilling a borehole are rotary drilling, in which the drill bit is connected to a drill string which is rotatably driven from the surface, and systems where the drill bit is rotated by a downhole motor, either a turbine or a positive displacement motor. Hitherto, fully controllable directional drilling has normally required the use of a downhole motor, and there are a number of well known methods for controlling the drilling direction using such a system.

However, although such downhole motor arrangements allow accurately controlled directional drilling to be achieved, there are reasons why rotary drilling is to be preferred. For example, steered motor drilling requires accurate positioning of the motor in a required rotational orientation, and difficulty may be experienced in this due, for example, to drag and to wind-up in the drill string. Accordingly, some attention has been given to arrangements for achieving a fully steerable rotary drilling system.

For example, British Patent Specification No. 2259316 describes various arrangements in which there is associated with the rotary drill bit a modulated bias unit. The bias unit comprises a number of hydraulic actuators spaced apart around the periphery of the unit, each having a movable thrust member which is hydraulically displaceable outwardly for engagement with the formation of the borehole being drilled. Each actuator has an inlet passage for connection to a source of drilling fluid trader pressure and an outlet passage for communication with the annulus. A selector control valve connects the inlet passages in succession to the source of fluid under pressure, as the bias unit rotates. The valve serves to modulate the fluid pressure supplied to each actuator in synchronism with rotation of the drill bit, and in selected phase relation thereto whereby, as the drill bit rotates, each movable thrust member is displaced outwardly at the same selected rotational position so as to bias the drill bit laterally and thus control the direction of drilling.

The present invention provides a development and improvement to the basic type of modulated bias unit to which Specification No. 2259316 relates.

SUMMARY OF THE INVENTION

According to the invention there is provided a modulated bias unit, for controlling the direction of drilling of a rotary drill bit when drilling boreholes in subsurface formations, comprising at least one hydraulic actuator having a movable thrust member which is hydraulically displaceable outwardly for engagement with the formation of the borehole being drilled, a selector control valve which modulates fluid pressure supplied to the actuator in synchronism with rotation of the drill bit, and in selected phase relation thereto so that, the drill bit rotates, the movable thrust member is displaced outwardly at the same selected rotational position so as to bias the drill bit laterally and thus control the direction of drilling the control valve being a disc valve comprising two relatively rotating elements having contiguous surfaces formed of polycrystalline diamond, and the rotating elements being maintained in coaxial relation by a bearing pin of superhard material which extends axially from one disc and engages in a central axial bearing aperture in the other disc.

Said disc valve may be located between a source of fluid under pressure and said hydraulic actuator, and operable to place said actuator alternately into and out of communication with said source of fluid under pressure.

One of said elements of the disc valve may be a disc having an outlet aperture leading to said hydraulic actuator, the other element of the disc valve comprising a sector of a disc which covers said outlet aperture during a portion of each of its rotations relative to said one element.

Said hydraulic actuator may comprise a chamber located adjacent the outer periphery of the unit, inlet means for supplying fluid to said chamber from said source of fluid under pressure, outlet means for delivering fluid from said chamber to a lower pressure zone, and a movable thrust member mounted for movement outwardly and inwardly with respect to the chamber in response to fluid pressure therein.

Said superhard material is preferably polycrystalline diamond, but other superhard materials may be employed, such as cubic boron nitride and amorphous diamond-like carbon.

Preferably there are provided a plurality of said hydraulic actuators spaced apart around the periphery of the unit, said control valve being arranged to modulate the fluid pressure supplied to said actuators so as to operate each actuator in succession as the unit rotates.

In any of the above arrangements, the pin may be separately formed from both elements of the disc valve and may engage in a central axial socket in each of said elements. Alternatively said pin may be an integral part of one of the elements.

Each element of the disc valve comprises a superhard layer bonded to a less hard substrate, such as tungsten carbide.

DETAILED DESCRIPTION OF THE PREFERRED EMBODIMENT

Figure 1:
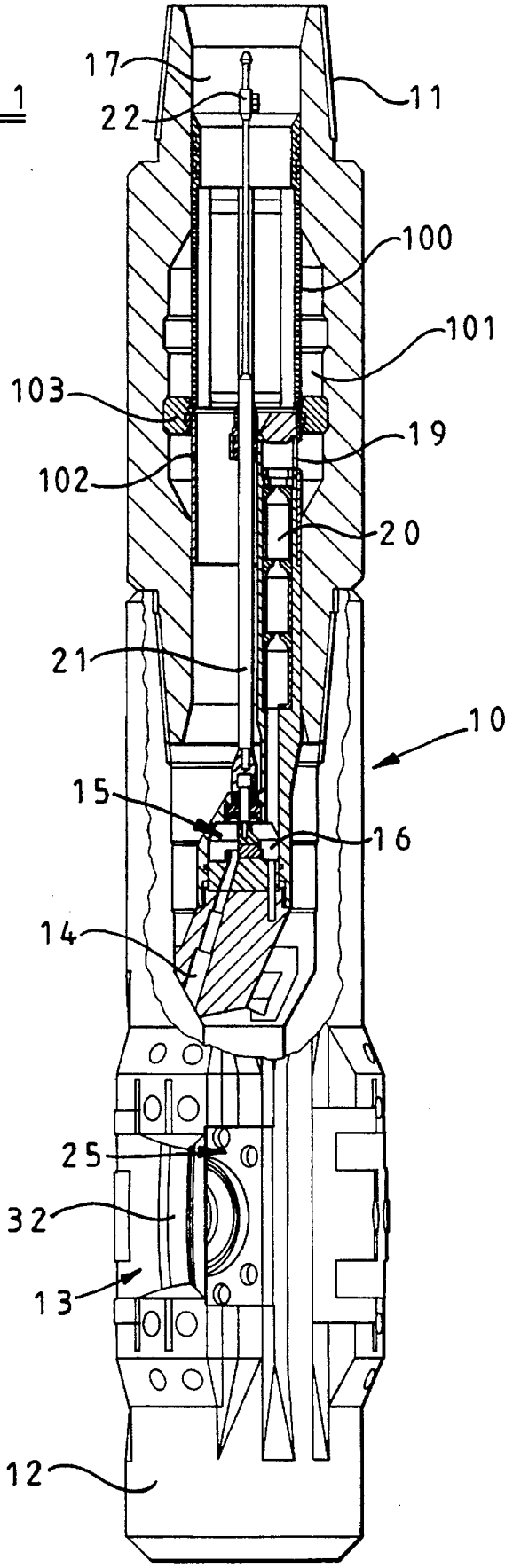
FIG. 1 is part longitudinal section, part side elevation of a modulated bias unit in accordance with the invention.

Referring to FIG. 1, the bias unit comprises an elongate main body structure 10 provided at its upper end with a tapered externally threaded pin 11 for coupling the unit to a drill collar, incorporating a control unit, for example a roll stabilised instrument package, which is in turn connected to the lower end of the drill string. The lower end 12 of the body structure is formed with a tapered internally threaded socket shaped and dimensioned to receive the standard form of tapered threaded pin on a drill bit. In the aforementioned British Patent Specification No. 2259316 the exemplary arrangements described and illustrated incorporate the modulated bias unit in the drill bit itself. In the arrangement shown in the accompanying drawings the bias unit is separate from the drill bit and may thus be used to effect steering of any form of drill bit which may be coupled to its lower end.

There are provided around the periphery of the bias unit, towards its lower end, three equally spaced hydraulic actuators 13, the operation of which will be described in greater detail below. Each hydraulic actuator 13 is supplied with drilling fluid under pressure through a passage 14 under the control of a rotatable disc valve 15 located in a cavity 16 in the body structure of the bias unit.

Drilling fluid delivered under pressure downwardly through the interior of the drill string, in the normal manner, passes into a central passage 17 in the upper part of the bias unit and flows outwardly through a cylindrical filter screen 100 into a surrounding annular chamber 101 formed in the surrounding wall of the body structure of the bias unit. The filter screen 100, and an imperforate tubular element 102 immediately below it, are supported by an encircling spider 103 within the annular chamber 101. Fluid flowing downwardly past the spider 103 to the lower pan of the annular chamber 101 flows through an inlet 19 into the upper end of a vertical multiple choke unit 20 through which the drilling fluid is delivered downwardly at an appropriate pressure to the cavity 16.

The disc valve 15 is controlled by an axial shaft 21 which is connected by a coupling 22 to the output shaft (not shown) of the aforementioned control unit (also not shown) in a drill collar connected between the pin 11 and the lower end of the drill string.

The control unit may be of the kind described and claimed in British Patent Specification No. 2257182.

During steered chilling, the control unit maintains the shaft 21 substantially stationary at a rotational orientation which is selected, either from the surface or by a downhole computer program, according to the direction in which the bottom hole assembly, including the bias unit and the drill bit, is to be steered. As the bias unit 10 rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally away from the position where the actuators are operated. The selected rotational position of the shaft 21 in space thus determines the direction in which the bias unit is laterally displaced and hence the direction in which the drill bit is steered.

The hydraulic actuators will now be described in greater detail with particular reference to FIG. 2.

Figure 2:
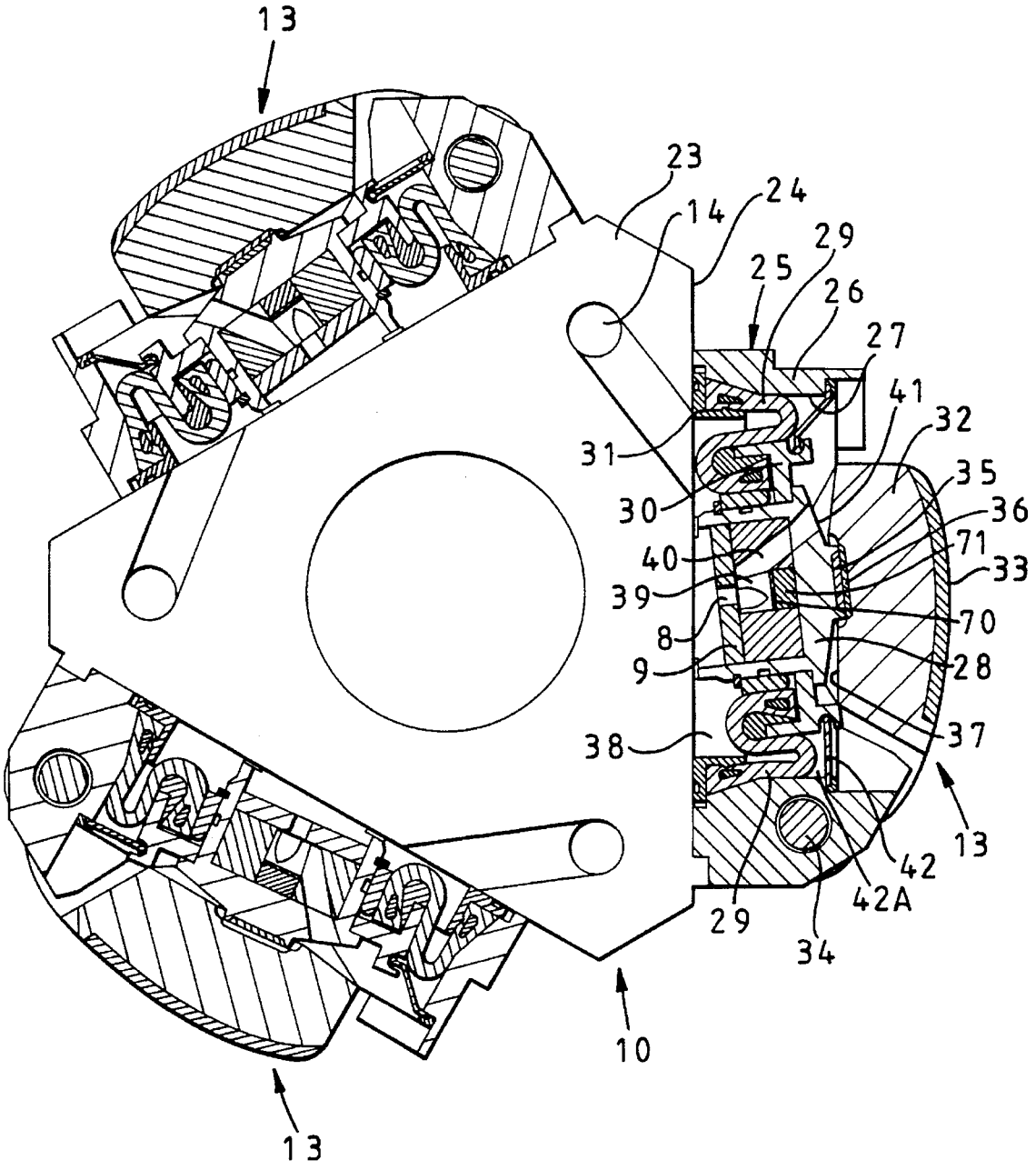
FIG. 2 is a horizontal cross-section through the bias unit, taken along the line 2—2 of FIG. 1.

Referring to FIG. 2: at the location of the hydraulic actuators 13 the body structure 10 of the bias unit comprises a central core 23 of the general form of an equilateral triangle so as to provide three outwardly facing fiat surfaces 24.

Mounted on each surface 24 is a rectangular support unit 25 formed with a circular peripheral wall 26 which defines a circular cavity 27. A movable thrust member 28 of generally cylindrical form is located in the cavity 27 and is connected to the peripheral wall 26 by a fabric-reinforced elastomeric annular rolling diaphragm 29. The inner periphery of the diaphragm 29 is clamped to the thrust member 28 by a clamping ring 30 and the outer periphery of the rolling diaphragm 29 is clamped to the peripheral wall 26 by an inner clamping ring 31. The diaphragm 29 has an annular portion of U-shaped cross-section between the outer surface or the clamping ring 30 and the inner surface of the peripheral wall 26.

A pad 32 having a part-cylindrically curved outer surface 33 is pivotally mounted on the support unit 25, to one side of the thrust member 28 and cavity 27, by a pivot pin 34 the longitudinal axis of which is parallel to the longitudinal axis of the bias unit. The outer surface of the cylindrical thrust member 28 is formed with a shallow projection having a flat bearing surface 35 which bears against a fiat bearing surface 36 in a shallow recess formed in the inner surface of the pad 32. The bearing surfaces 35 and 36 are hardfaced.

The part of the cavity 27 between the robing diaphragm 29 and the surface 24 of the central core 23 defines a chamber 38 to which drilling fluid under pressure is supplied through the aforementioned associated passage 14 when the disc valve 15 is in the appropriate position. When the chamber 38 of each hydraulic unit is subjected to fluid under pressure, the thrust member 28 is urged outwardly and by virtue of its engagement with the pad 32 causes the pad 32 to pivot outwardly and bear against the formation of the surrounding borehole and thus displace the bias unit in the opposite direction away from the location, for the time being, of the pad 32. As the bias unit rotates away from the orientation where a particular hydraulic actuator is operated, the next hydraulic actuator to approach that position is operated similarly to maintain the displacement of the bias unit in the same lateral direction. The pressure of the formation on the previously extended pad 32 thus increases, forcing that pad and associated thrust member 28 inwardly again. During this inward movement fluid is expelled from the chamber 38 through a central choke aperture 8 formed in a plate 9 mounted on the thrust member 28, the aperture 8 communicating with a cavity 39. Three circumferentially spaced diverging continuation passages 40 lead from the cavity 39 to three outlets 41 respectively in the outwardly facing surface of the thrust member 28, the outlets being circumferentially spaced around the central bearing surface 35.

Drilling fluid flowing out of the outlets 41 washes over the inner surface 37 of the pad 32 and around the inter-engaging bearing surfaces 35 and 36 and thus prevents silting up of this region with debris carried in the drilling fluid which is at all times flowing past the bias unit along the annulus. The effect of such silting up would be to jam up the mechanism and restrict motion of the pad 32.

In the rolling diaphragm 29 were to be exposed to the flow of drilling fluid in the annulus, solid particles in the drilling fluid would be likely to find their way between the diaphragm 29 and the surfaces of the members 26 and 30 between which it rolls, leading to rapid abrasive wear of the diaphragm. In order to prevent debris in the drilling fluid from abrading the rolling diaphragm 29 in this manner, a protective further annular flexible diaphragm 42 is connected between the clamping ring 30 and the peripheral wall 26 outwardly of the rolling diaphragm 29, The flexible diaphragm 42 may be fluid permeable so as to permit the flow of clean drilling fluid into and out of the annular space 42A between the diaphragms 29 and 42, while preventing the ingress of solid particles and debris into that space.

Instead of the diaphragm 42 being fluid permeable, it may be impermeable and in this case the space 42A between the diaphragm 42 and the rolling diaphragm 29 may be filled with a flowable material such as grease. In order to allow for changes in pressure in the space between the diaphragms, a passage (not shown) may extend through the peripheral wall 26 of the support unit 25, so as to place the space between the diaphragms 42, 29 into communication with the annulus between the outer surface of the bias unit and the surrounding borehole. In order to inhibit escape of grease through such passage, or the ingress or drilling fluid from the annulus, the passage is filled with a flow-resisting medium, such as wire wool or similar material.

Each rectangular support unit 25 may be secured to the respective surface 24 of the core unit 23 by a number of screws. Since all the operative components of the hydraulic actuator, including the pad 32, thrust member 28 and rolling diaphragm 29, are all mounted on the unit 25, each hydraulic actuator comprises a unit which may be readily replaced in the event of damage or in the event of a unit of different characteristics being required.

Figure 3:
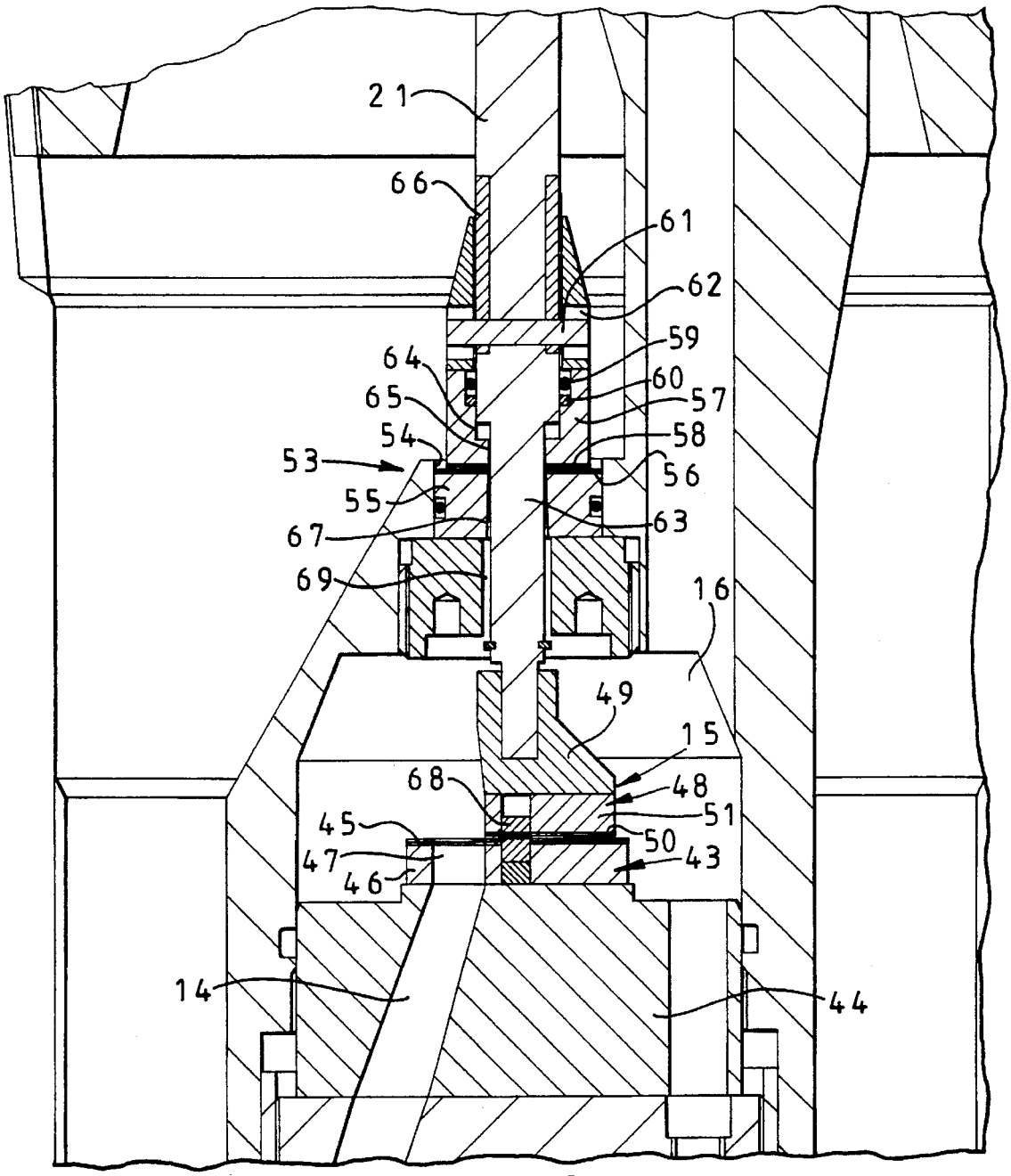
FIG. 3 is a longitudinal section, on an enlarged scale, of parts of the bias unit of FIG. 1, and FIGS. 4 and 5 are plan views of the two major components of the disc valve employed in the bias unit.

FIGS. 3–5 show in greater detail the construction of the disc valve 15 and associated components. The disc valve comprises a lower disc 43 which is fixedly mounted, for example by brazing or gluing, on a fixed part 44 of the body structure of the bias unit. The lower disc 43 comprises an upper layer 45 of polycrystalline diamond bonded to a thicker substrate 46 of cemented tungsten carbide. As best seen in FIG. 5, the disc 43 is formed with three equally circumferentially spaced circular apertures 47 each of which registers with a respective passage 14 in the body structure.

The upper element 48 of the disc valve is brazed or glued to a structure 49 on the lower end of the shaft 21 and comprises a lower facing layer 50 of polycrystalline diamond bonded to a thicker substrate 51 of tungsten carbide, As best seen in FIG. 4, the element 48 comprises a sector of a disc which is slightly less than 180° in angular extent. The arrangement is such that as the lower disc 43 rotates beneath the upper element 48 (which is held stationary, with the shaft 21, by the aforementioned roll stabilised control unit) the apertures 47 are successively uncovered by the sector-shaped element 48 so that drilling fluid under pressure is fed from the cavity 16, through the passages 14, and to the hydraulic actuators in succession. It will be seen that, due to the angular extent of the element 48, the following aperture 47 begins to open before the previous aperture has closed.

In order to locate the elements 43 and 48 of the disc valve radially, an axial pin 68 of polycrystalline diamond is received in registering sockets in the two elements. The pin may be non-rotatably secured within one of the elements, the other element being rotatable around it. Alternatively the pin may be integrally formed with one or other of the valve elements. Instead of being formed from polycrystalline diamond, the axial pin 68 may be formed from any other superhard material, such as cubic boron nitride or amorphous diamond-like carbon (ADLC).

It will be seen that the disc valve 15 also serves as a thrust bearing between the shaft 21 and the body structure of the bias unit. The provision of mating polycrystalline diamond surfaces on the contiguous surfaces of the valve provides a high resistance to wear and erosion while at the same time providing a low resistance to relative rotation.

As previously mentioned, drilling fluid is supplied to the cavity 16 through the multiple choke arrangement 20 and consequently there is a significant pressure difference between the interior of the cavity 16 and the central passage 17 where the main part of the shaft 21 is located. In order to accommodate this pressure difference a rotating seal 53 is provided between the shaft 21 and the body structure of the bias unit.

The seal 53 is located in a cylindrical chamber 54 and comprises a lower annular carrier 55 fixed to the body structure of the bias unit and formed at its upper surface with an annular layer 56 of polycrystalline diamond surrounding a lower reduced-diameter portion 63 of the shaft 21. The upper part of the seal comprises a sleeve 57 which is mounted on the shaft 21 and is formed on its lower end surface with an annular layer 58 of polycrystalline diamond which bears on the layer 56. The sleeve 57 is axially slideable on the shaft 21 so as to maintain the seal between the layers 56 and 58 while accommodating slight axial movement of the shaft 21. To this end an O-ring 59 is provided in an annular recess between the sleeve 57 and the shaft 21 so as to locate the Sleeve 57 on the shaft while permitting the slight axial movement. A backing ring 60 is located adjacent the O-ring to prevent its being extruded from the recess in use. A pin 61 is secured through the shaft 21 and the ends of the pin are received in axial slots 62 in the sleeve 57 to permit limited relative axial movement between the shaft and the sleeve.

As previously mentioned, the pressure in the region above the seal 53 is significantly greater than the pressure in the valve chamber 16. The seal is therefore designed to be partly balanced, in known manner, in order to reduce the axial lead on the seal resulting from this pressure difference, and hence reduce the torque applied by the seal.

Thus, the bore 64 in the sleeve 57 is stepped, the reduced-diameter portion 63 of the shalt 21 passing through a corresponding reduced diameter part 65 of the bore 64. This effectively reduces the ratio between the areas of the sleeve 57 which are subjected to the higher pressure and lower pressure respectively so as to reduce the net effective downward closing force on the seal.

It is also desirable to accommodate any slight angular misalignment between the shaft 21 and the seal 53, and for this purpose the portion of the shaft 21 which is surrounded by the upper part of the sleeve 57 is encircled by a sleeve 66 of natural or synthetic rubber or other suitable resiliently yieldable material. This permits tilting of the shaft 21 relative to the sleeve 57, while still maintaining the contact between the shaft and sleeve. Corresponding tilting of the lower part 63 of the shaft 21 is permitted by enlargement of the bores 65, 67 and 69 through which the part 21 of the shaft passes.

In a modified arrangement, not shown, the multiple choke 20 may be located on the axis of the bias unit so that the shaft 21 passes downwardly through the centre of the choke, the choke apertures then being annular. In this case the multiple choke itself serves as a labyrinth seal between the cavity 16 and the central passage 17 in the bias unit and it is therefore not necessary to provide the rotating seal 53, or similar seal, between the shaft and the body structure of the bias unit.

We claim:

1. A modulated bias unit, for controlling the direction of drilling of a rotary drill bit when drilling boreholes in subsurface formations, comprising at least one hydraulic actuator having a movable thrust member which is hydraulically displaceable outwardly for engagement with the formation of the borehole being drilled, a selector control valve which modulates fluid pressure supplied to the actuator in synchronism with rotation of the drill bit, and in selected phase relation thereto so that, as the drill bit rotates, the movable thrust member is displaced outwardly at the same selected rotational position so as to bias the drill bit laterally and thus control the direction of drilling, the control valve being a disc valve comprising two relatively rotating elements having contiguous surfaces formed of polycrystalline diamond, and the rotating elements being maintained in coaxial relation by a bearing pin of superhard material which extends axially from one disc and engages in a central axial bearing aperture in the other disc.

2. A modulated bias unit according to claim 1, wherein said disc valve is located between a source of fluid under pressure and said hydraulic actuator, and is operable to place said actuator alternately into and out of communication with said source of fluid under pressure.

3. A modulated bias unit according to claim 1, wherein one of said elements of the disc valve is a disc having an outlet aperture leading to said hydraulic actuator, and the other element of the disc valve comprises a sector of a dig which covers said outlet aperture during a portion of each of its rotations relative to said one element.

4. A modulated bias unit according to claim 1, wherein said hydraulic actuator comprises a chamber located adjacent the outer periphery of the unit, inlet means for supplying fluid to said chamber from said source of fluid under pressure, outlet means for delivering fluid from said chamber to a lower pressure zone, and a movable thrust member mounted for movement outwardly and inwardly with respect to the chamber in response to fluid pressure therein.

5. A modulated bias unit according to claim 1, wherein said superhard material is selected from polycrystalline diamond, cubic boron nitride and amorphous diamond-like carbon.

6. A modulated bias unit according to claim 1, wherein there are provided a plurality of said hydraulic actuators spaced apart around the periphery of the unit, said control valve being arranged to modulate the fluid pressure supplied to said actuators so as to operate each actuator in succession as the unit rotates.

7. A modulated bias unit according to claim 1, wherein the pin is separately formed from both elements of the disc valve and engages in a central axial socket in each of said elements.

8. A modulated bias unit according to claim 1, wherein said pin is an integral part of one of said elements.

9. A modulated bias unit according to claim 1, wherein each element of the disc valve comprises a superhard layer bonded to a less hard substrate.

10. A modulated bias unit according to claim 9, wherein said substrate is formed from tungsten carbide.

* * * * *